United States Patent [19]

Stanton et al.

[11] Patent Number: 4,804,121

[45] Date of Patent: Feb. 14, 1989

[54] GOLF BAG BELT ORGANIZER

[76] Inventors: Boyd R. Stanton; George Spector, both of 233 Broadway, Rm 3615, New York, N.Y. 10007

[21] Appl. No.: 665,703

[22] Filed: Oct. 29, 1984

[51] Int. Cl.[4] ..... B63C 11/30

[52] U.S. Cl. ..... 224/191; 224/901; 224/919; 224/224; 206/315.5

[58] Field of Search ..... 224/191, 901, 919, 224; 206/315.5, 315.3

[56] References Cited

U.S. PATENT DOCUMENTS

| | | | |
|---|---|---|---|
| 787,853 | 4/1905 | Mills | 224/224 |
| 4,350,194 | 9/1982 | Brown | 206/315.5 |
| 4,440,525 | 4/1984 | Perla | 224/901 |

*Primary Examiner*—Henry J. Recla

[57] ABSTRACT

A golf belt for containing and carrying various articles is provided and consists of an outer elongated panel affixed to an inner elongated panel in such a way as to form a plurality of pockets to receive the various articles therein and a fastener device for securing ends of the inner elongated panel in position for use around top cuff of a golf bag or the waist of a golfer.

3 Claims, 1 Drawing Sheet

GOLF BAG BELT ORGANIZER

BACKGROUND OF THE INVENTION

The instant invention relates generally to holders for golf equipment and more specifically it relates to a golf belt for containing and carrying various articles.

Numerous holders for golf equipment have been provided in prior art that are adapted to store accessories for persons playing the game of golf. For example U.S. Pat. Nos. 1,955,650; 1,973,819 and 2,508,190 all are illustrative of such prior art. While these units may be suitable for the particular purpose to which they address, they would not be as suitable for the purposes of the present invention as heretofore described.

SUMMARY OF THE INVENTION

A principle object of the present invention is to provide a golf belt for containing and carrying various articles that is designed to be detachably secured around top cuff of a golf bag or the waist of a golfer.

Another object is to provide a golf belt for containing and carrying various articles that includes a separate pocket for each article and is capable of receiving articles of all shapes and sizes.

An additional object is to provide a golf belt for containing and carrying various articles that has a foldable back extension piece so that auxiliary pockets can be added when needed.

A further object is to provide a golf belt for containing and carrying various articles that is simple and easy to use.

A still further object is to provide a golf belt for containing and carrying various articles that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
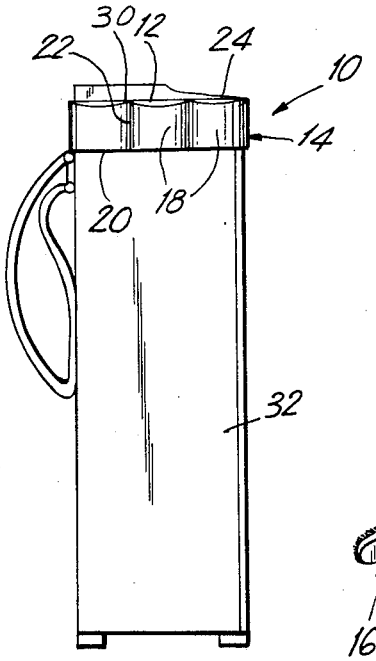
FIG. 1 is an elevational view of a golf bag showing the invention wrapped around the top cuff.
Figure 2:
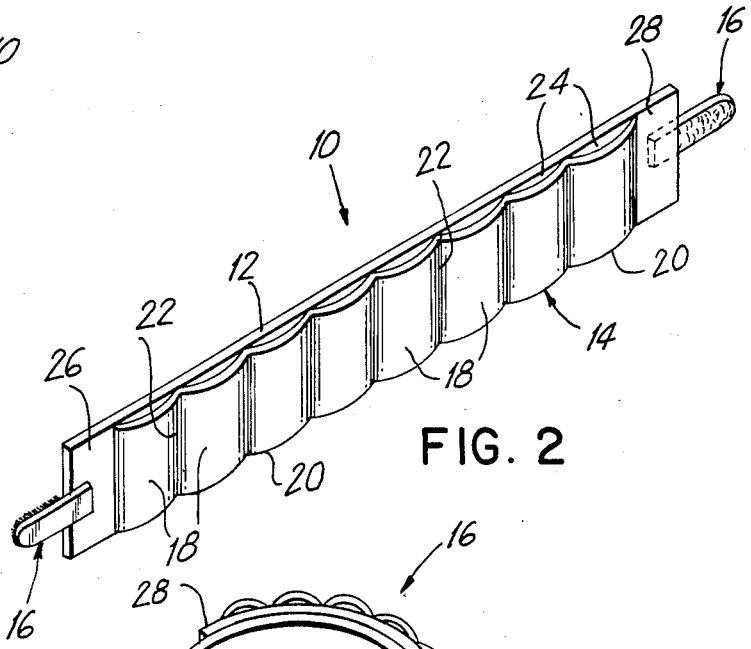
FIG. 2 is a flat perspective view of the invention.

Turning now descriptively to the drawings, in which similar reference characters denote similar elements throughout the several views, FIGS. 1 and 2 illustrates a golf belt 10 for containing and carrying various articles, such as old balls, new balls, tees, score card, pencil, glasses, comb, wallet, cigarettes, matches, etc.

The golf belt 10 consists of an inner elongated panel 12, an outer elongated panel 14 and a fastener device 16.

The outer elongated panel 14 is affixed to the inner elongated panel 12 in such a way as to form a plurality of pockets 18. The pockets 18 are affixed at bottom 20 and sides 22 to the inner elongated panel 12 whereby the pockets have open tops 24 to receive the various articles therein.

The fastener device 16 is for securing ends 26 and 28 of the inner elongated panel 12 in position for use around top cuff 30 of a golf bag 32 as shown in FIG. 1 or around the waist of a golfer (not shown). The fastener device 16 as shown in FIG. 2 is a loop-hook fabric fastener. Other types can be employed such as buckle and strap or adhesive.

Figure 3:
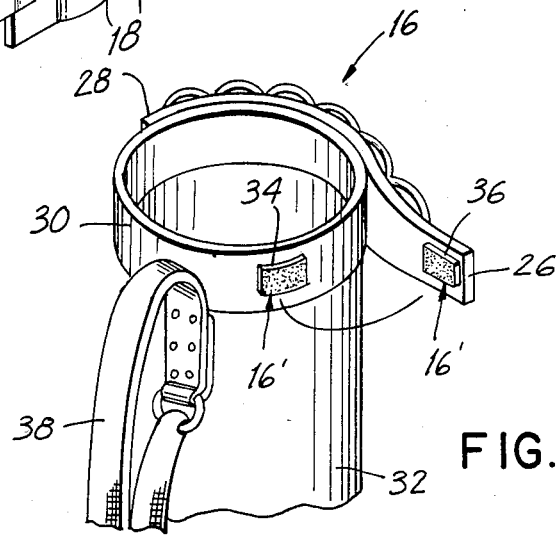
FIG. 3 is a perspective view of the top portion of the golf bag showing a first modification whereby the belt is partially wrapped around the top cuff.

Another type of fastener 16' is shown in FIG. 3. In this case the golf belt 10 is partially wrapped around the top cuff 30 of the golf bag 32. The fastener 16' is a loop-hook fabric fastener with one half 34 attached to the top cuff 30 and the other half 36 attached to the end 26. Instead of ends 26 and 28 secured together the ends 26 and 28 are secured to the top cuff 30, so that the articles in pockets 18 of the golf belt 10 will not interfere with a person carrying the shoulder strap 38 of the golf bag 30.

Figure 4:
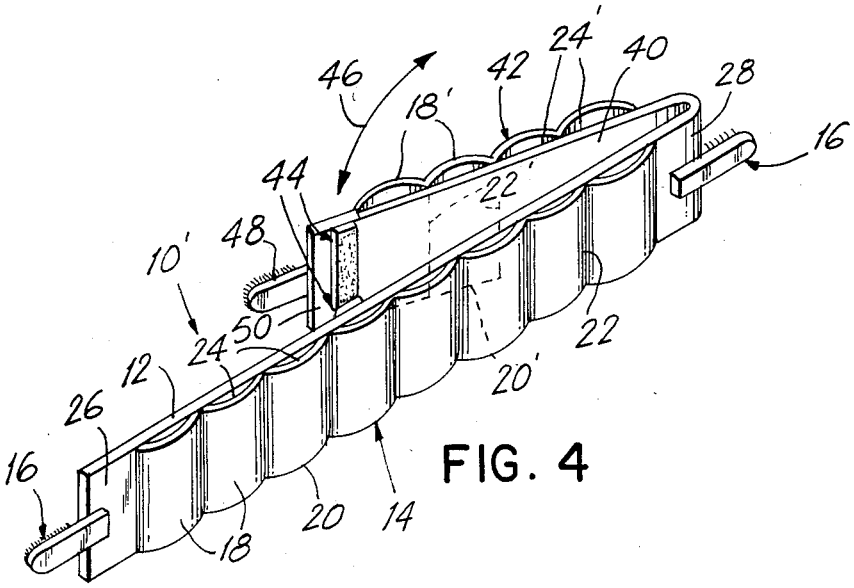
FIG. 4 is a flat perspective view of a second modification whereby the belt has a foldable back extension piece so that auxiliary pockets can be added when needed such as worn around the waist of a golfer.

A modified golf belt 10' is shown in FIG. 4. The inner elongated panel 12 has a foldable back extension piece 40 at end 28. A second outer elongated panel 42 is affixed to the extension piece 40 in such a way as to form a plurality of auxiliary pockets 18'. The auxiliary pockets 18' are affixed at bottom 20' and side 22' to the extension piece 40 whereby the auxiliary pockets 18' have open tops 24' to receive additional articles therein. A fastener device 44 is provided for securing the extension piece 40 to the inner elongated panel 12 when folded back as indicated by arrow 46. A fastener device 48 is for securing free end 50 of the extension piece in position for use. The fastener device 44 is a loop-hook fabric fastener and fastener device 48 is one half of a loop-hook fabric fastener.

The inner elongated panel 12 and outer elongated panels 41 and 42 can be made out of plastic material so that the outer elongated panels can be affixed to the inner elongated panel 12 by heat sealing to form the pockets 18 and 18'. The inner elongated panel 12 and outer elongated panels 14 and 42 can also be made out of cloth material so that the outer elongated panels can be affixed to the inner elongated panel 12 by stitching to form the pockets 18 and 18'.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A golf belt for containing and carrying various articles which comprises:

(a) an inner elongated panel;

(b) an outer elongated panel affixed to said inner elongated panel in such a way as to form a plurality of pockets having open tops that can receive said various articles therein;

(c) means adapted for securing ends of said inner elongated panel in position for use on the waist of the user and on a golf bag perimeter; and (d) a foldable extension having additional pockets with means for mounting said extension folded against said inner panel with said additional pockets parallel to and inward of said outer pockets.

2. A golf belt as in claim 8, further comprising:

(a) means for securing said extension to said inner elongated panel when folded back; and (b) means for securing the free end of said extension to the user and to the golf bag.

3. A golf belt as in claim 9, wherein the second said means comprise mating fasteners mounted on said extension and said inner panel.

* * * * *